US005495861A

United States Patent [19]

Liberman

[11] Patent Number: 5,495,861

[45] Date of Patent: Mar. 5, 1996

[54] HAIR BUNDLING DEVICE

[76] Inventor: Moni Y. Liberman, 124 W. 93rd St. Ste. 4F, New York, N.Y. 10025

[21] Appl. No.: 282,823

[22] Filed: Aug. 1, 1994

Related U.S. Application Data

[63] Continuation-in-part of Ser. No. 148,658, Nov. 5, 1993, abandoned.

[51] Int. Cl.[6] ..... A45D 8/00

[52] U.S. Cl. ..... 132/273; 132/276; 24/563

[58] Field of Search ..... 132/273, 275, 132/276; D28/39, 40, 41; 40/645; 24/563

[56] References Cited

U.S. PATENT DOCUMENTS

| | | | |
|---|---|---|---|
| 46,524 | 10/1864 | Bernstein | D28/39 |
| 476,482 | 6/1892 | Oliver | 24/563 |
| 2,455,715 | 12/1948 | Webster | 132/273 |
| 2,924,228 | 2/1960 | McGee | 132/273 |

FOREIGN PATENT DOCUMENTS

| | | | |
|---|---|---|---|
| 23065 | 8/1898 | France | 132/144 |
| 2490939 | 4/1982 | France | 132/273 |
| 2631527 | 11/1989 | France | 132/273 |
| 0002421 | 6/1899 | United Kingdom | 132/273 |

OTHER PUBLICATIONS

Liberman, "Declaration of Moni Y. Liberman," Feb. 7, 1994.

*Primary Examiner*—John G. Weiss
*Attorney, Agent, or Firm*—Charles E. Bruzga

[57] ABSTRACT

A device for holding hair in a bundle comprises a body member configured in a generally spiral manner from proximate a main axis of the device to an opening for receiving hair. Portions of the body member that are radially adjacent to each other with respect to the main axis present confronting surfaces for applying pressure to hair and define a generally spirally shaped hair-receiving volume. A sufficient extent of the body member preferably comprises resilient material for allowing an ordinary user to increase the hair-receiving volume, during insertion of the device into a bundle of hair, more than about 50 percent in an outermost 180° spiral region bounded by the hair-receiving opening. When the device is unflexed, the hair-receiving volume preferably decreases in radial dimension with respect to the main axis more than about 15 percent from a radially outer, to a radially inner, portion of one spiral turn of the hair-receiving volume other than innermost and outermost 45° spiral regions of the hair-receiving volume, so as to create an increasing holding pressure on hair received within the hair-receiving volume as the hair is moved radially inwardly along the one spiral turn. The body member preferably includes a handle to facilitate manipulation of the device into a hair-securing position.

17 Claims, 4 Drawing Sheets

HAIR BUNDLING DEVICE

This is a continuation-in-part of application Ser. No. 08/148,658, filed on Nov. 5, 1993 and now abandon.

FIELD OF THE INVENTION

The present invention relates to a device for securing hair into a bundle.

BACKGROUND OF THE INVENTION

Various devices have been used in the past for securing, into a bundle, the hair of a person. For instance, an elastic band has been used to secure hair in a bundle to form, for instance, what is known as a "pony tail." An elastic band, however, is often inconvenient to apply to bundle of hair, for several reasons. First, the full length of the hair of the bundle must be passed through an elastic band, at least a band in the typical form of a continuous loop. Not uncommonly, applying an elastic band to a bundle of hair will cause strands of hair to be unintentionally pulled, causing pain. Additionally, an elastic band typically requires a relatively high force to apply it to a bundle of hair. Such high pressure, not uncommonly, causes a breakage line on the strands of hair at the surface of the hair bundle, which are directly pressed by the elastic band. At the same time, the radially inner strands of hair of the hair bundle, most separated from the elastic band, are under considerably less pressure than the hair at the surface of the bundle. This, not uncommonly, allows such radially inner strands of hair to freely slide relative to each other, allowing the hair to become out of place.

Another prior art device for securing hair into a bundle comprises a mechanical clip that uses spring pressure to secure the hair. Such mechanical clip has two generally straight sides that are placed on the respective sides of a bundle of hair to be secured. The ends of the mechanical clip are joined together, under spring pressure, so as to exert force on the bundle of hair. The mechanical clip is easier to apply to a bundle of hair than an elastic band, because it can be applied from a transverse direction to the bundle of hair. However, a mechanical clip also shares, with an elastic band, the above-mentioned drawbacks of applying high force to a surface of the hair bundle, not uncommonly causing a breakage line on hair strands at the surface of the bundle, while the inner strands of hair, at the center of hair bundle, are under considerably less pressure, not uncommonly allowing the hair to become out of place.

It would thus be desirable to provide a hair bundling device that exerts, on a bundle of hair, a more uniform pressure than has been attained with the foregoing prior art devices.

OBJECTS AND SUMMARY OF THE INVENTION

It is, accordingly, an object of the invention to provide a hair bundling device that exerts, on a bundle of hair, a more nearly uniform pressure than has been attained with the prior art devices mentioned above.

It is, yet, another object of the invention to provide a hair bundling device of the foregoing type that can accommodate a wide range of hair bundles of different volumes and thicknesses of hair strands.

An additional object of the invention to provide a hair bundling device of the foregoing type that can be conveniently applied from a direction transverse to the bundle of hair, thereby avoiding the need to pass the free ends of such hair through the device.

Still another object of the invention is to provide a hair bundling device of the foregoing type that is so lightweight that typical forces of momentum, caused from a user jogging, for instance, fail to dislodge the device from the hair.

A further object of the invention to provide a hair bundling device of the foregoing type that can be manufactured economically.

In a preferred form, the present invention provides a device for holding hair in a bundle. The device comprises a body member configured in a generally spiral manner from proximate a main axis of the device to an opening for receiving hair. Portions of the body member that are radially adjacent to each other with respect to the main axis present confronting surfaces for applying pressure to hair and define a generally spirally shaped hair-receiving volume. A sufficient extent of the body member comprises resilient material for allowing an ordinary user to increase the hair-receiving volume, during insertion of the device into a bundle of hair, more than about 50 percent in an outermost 180° spiral region bounded by the hair-receiving opening. When the device is unflexed, the hair-receiving volume decreases in radial dimension with respect to the main axis more than about 15 percent from a radially outer, to a radially inner, portion of one spiral turn of the hair-receiving volume other than innermost and outermost 45° spiral regions of the hair-receiving volume, so as to create an increasing holding pressure on hair received within the hair-receiving volume as the hair is moved radially inwardly along the one spiral turn.

In another preferred form, the present invention provides a device for holding hair in a bundle that comprises a body member configured in a generally spiral manner from proximate a main axis of the device to an opening for receiving hair. Portions of the body member that are radially adjacent to each other with respect to the main axis present confronting surfaces for applying pressure to hair and define a generally spirally shaped hair-receiving volume. The body member comprises, in the proximity of the hair-receiving opening, a handle comprising a first surface that is substantially parallel to a radius originating at the main axis, for facilitating one-finger pulling of the handle tangentially to the main axis for rotating the hair-receiving opening so as to receive hair. The handle further comprises a grippable portion for facilitating pulling of the handle radially outwardly from the main axis for increasing the hair-receiving volume. Preferably, when the device is unflexed, the hair-receiving volume decreases in radial dimension with respect to the main axis more than about 15 percent from a radially outer, to a radially inner, portion of one spiral turn of the hair-receiving volume other than innermost and outermost 45° spiral regions of the hair-receiving volume, so as to create an increasing holding pressure on hair received within the hair-receiving volume as the hair is moved radially inwardly along the one spiral turn. Further, the handle beneficially further includes a second surface oriented in a substantially orthogonal manner to the main axis for facilitating one-finger pulling of the handle radially outwardly from the main axis for increasing the hair-receiving volume.

BRIEF DESCRIPTION OF THE DRAWING FIGURES

The foregoing objects and further advantages and features of the invention will become apparent from the following description taken in conjunction with the drawing, in which like reference numerals refer to like parts, and in which.

DETAILED DESCRIPTION OF THE PREFERRED EMBODIMENTS

Figure 1:
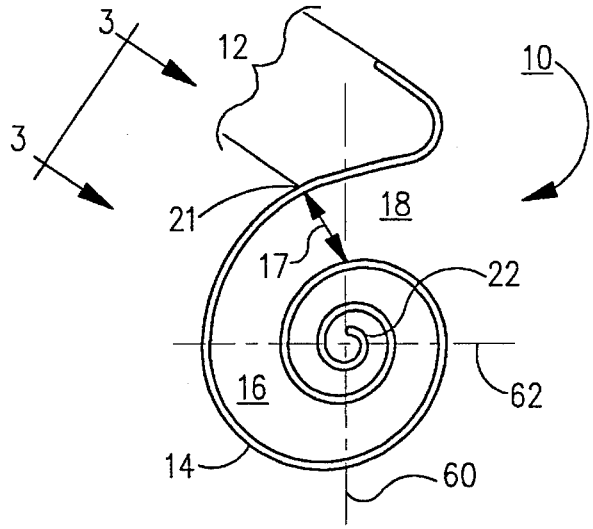
FIG. 1 is an upper plan view of a hair bundling device in accordance with the invention.
Figure 2:
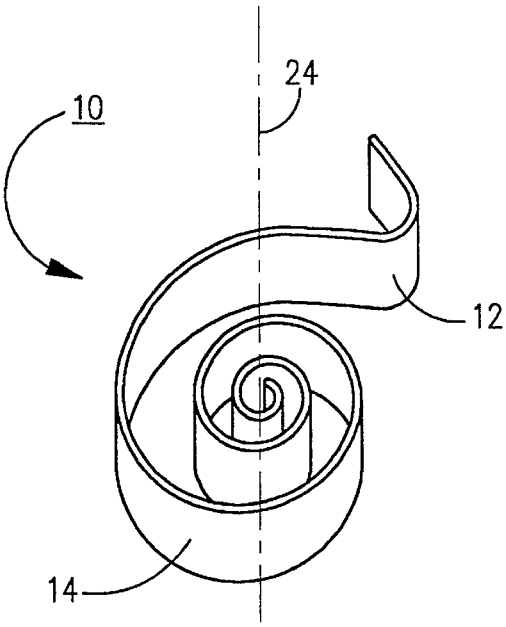
FIG. 2 is a perspective view of the inventive hair bundling device of FIG. 1.

FIGS. 1 and 2 respectively show top and perspective views of a hair bundling device 10, in accordance with one embodiment of the invention. Device 10 includes, as best shown in FIG. 1, a handle section 12, and an adjoining spiral section 14 of generally spiral configuration. Vertically shown axis 60 and horizontally shown axis 62 intersect at the center, or radially inner starting point, of such spiral configuration. Volume 16 is defined between adjacent, radially directed surfaces of spiral section 14, e.g. surfaces 17. Volume 16 constitutes a generally spirally shaped, volume for receiving and securing hair. Volume 18, in addition to also forming a hair-receiving volume, constitutes an inlet volume for feeding hair into hair-receiving volume 16. The boundary between handle 12 and spiral section 14, coinciding with the boundary between hair-receiving volume 16 and inlet volume 17, occurs at point 21. At point 21, the angle of divergence between confronting surfaces 17 of adjacent portions of spiral section 14 increases in discontinuous manner in going from hair-receiving volume 16 to inlet volume 17. The main purpose of inlet volume 18, as a result, is to feed hair into hair-receiving volume 16, where it is therein secured by the device, as described below. At a radially inner end of spiral section 14, a stop 22 is provided to terminate the radially inner end of hair-receiving volume 16.

FIG. 2 shows a main axis 24 of device 10, which is located at the center of the generally spiral configuration of spiral section 14.

Figure 3:
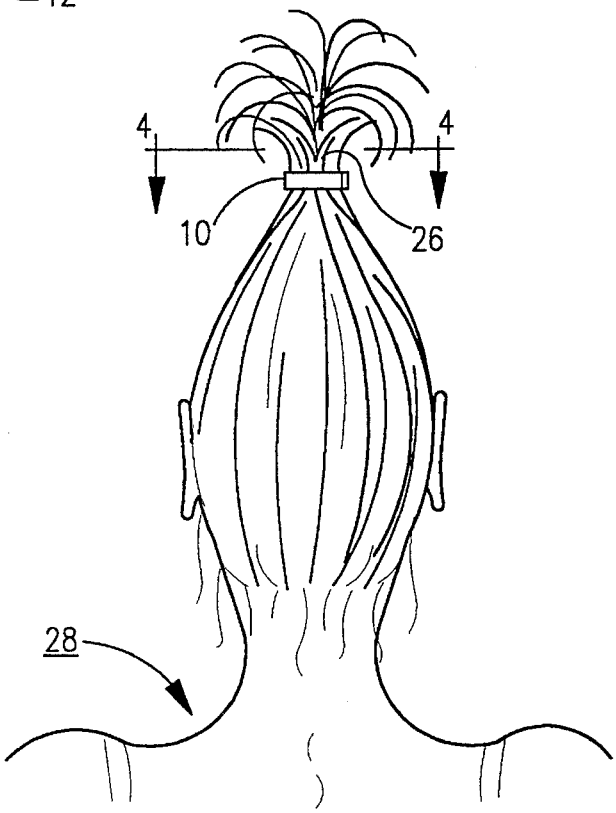
FIG. 3 shows a view of the hair bundling device of FIG. 1, taken at arrows 3, 3 in FIG. 1, as applied to a bundle of hair of a user.

FIG. 3 is a view of hair bundling device 10, taken at arrows 3, 3 in FIG. 1, with the device securing a bundle of hair 26 of a person 28. The main axis of hair bundling device 10, shown at 24 in FIG. 2, approximately coincides with the longitudinal axis (not shown) of hair bundle 26.

Figure 4:
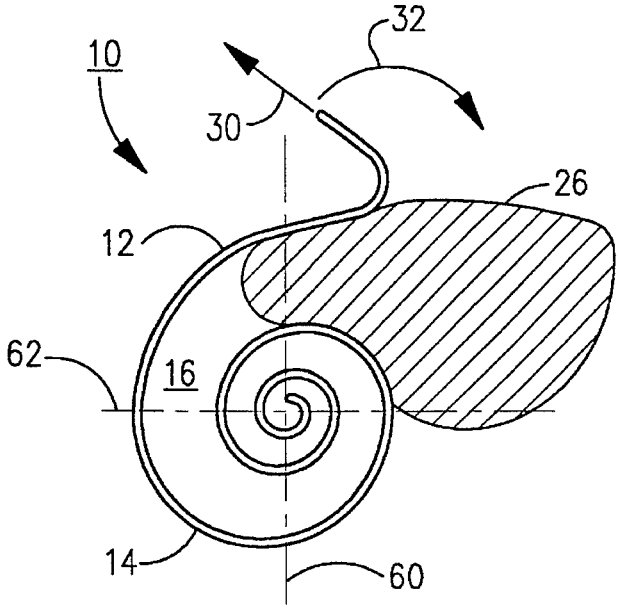
FIG. 4 shows a view of the hair bundling device of FIG. 3, taken at arrows 4, 4 in FIG. 3, together with indications of typical forces that are applied to the device to secure a bundle of hair.

FIG. 4, which is taken from the perspective of arrows 4, 4 in FIG. 3, shows a bundle 26 of hair, which is desired to be secured by hair bundling device 10. For simplicity, hair bundle 26 is shown collectively as an integral bundle, with 45° cross section lines; in actual practice, however, hair bundle 26 comprises multiple strands of hair. To apply device 10 to hair bundle 26, a preferred procedure is to pull handle 12 generally radially outwardly from spiral section 14, as indicated by arrow 30. Such pulling action expands hair-receiving volume 16, to facilitate entry of hair into such volume, and typically may continue for about ¾ to 1 revolution about the main axis of the hair bundle. At the same time, handle 12 is pulled in direction 32; that is, rotated, or twisted, about hair bundle 26. Such twisting action forces strands of hair from bundle 26 into hair-receiving volume 16, and typically continues after force 30 is stopped.

Preferably, spiral section 14 of the device comprises (i.e. resilient) material that can be deflected from an original position by the force of the hand of an ordinary user of the device. Such springlike nature is required to expand the volume of hair-receiving volume 16 as just mentioned in connection with FIG. 4. Such springlike nature of spiral section 14, however, is not essential to realize substantial benefit of the disclosed inventive device. Thus, for instance, only an inner-radial portion of spiral section 14 may comprise springlike material, preferably for at least about 1½ to 2 spiral revolutions.

In any event, the springlike nature of at least some portion of spiral section 14 permits expansion of hair-receiving volume 16 along at least some portion of its length. When a user stops applying force to the hair-bundling device 10 (e.g., force 32, FIG. 4), the springlike nature of at least some portion of spiral section 14 causes spiral section to tend to return to an original, non-deflected position. In doing so, pressure from the radially directed walls of spiral section 14 (not shown) is applied to the hair contained in hair-receiving volume 16, so as to secure the hair in the spiral section.

To facilitate entry of strands of hair of bundle 26 into hair-receiving volume 16, it is preferred that generally spirally-shaped hair-receiving volume 16 diminishes in radial dimension, and hence volume, from larger to smaller radii of spiral section 14; preferably such diminishing occurs in a substantially continual, or even constant manner.

Figure 5:
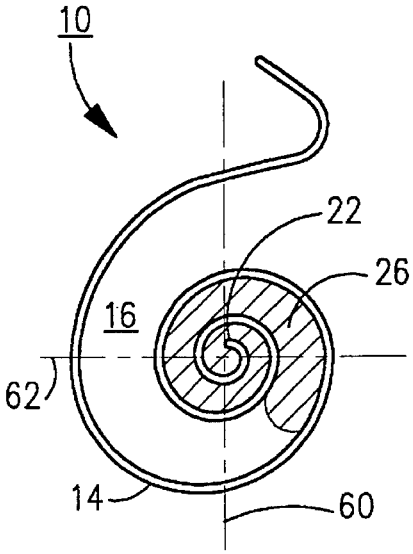
FIGS. 5 and 6 are views similar to FIG. 4, but showing final, secured positions of bundles of hair of different thicknesses.

FIG. 5 is similar to FIG. 4, except that it shows a bundle of thin hair 26 received within hair-receiving volume 16 all the way, radially inwardly, with the hair abutting stop 22. When thin hair 26 thus fills the inner radial portion of hair-receiving volume 16, device 10 resists further twisting action shown by arrow 32 in FIG. 4. As is apparent from the above description, thin hair 26 is held in place by the springlike pressure exerted by the portion of spiral section 14 (preferably all of section 14) comprising springlike material. Thin hair 26 is also held in place by the pressure it exerts on the walls of spiral section 14, resulting from hair 26 being forced into hair-receiving volume 16, whose capacity to receive hair decreases at lower radial distances.

Figure 6:
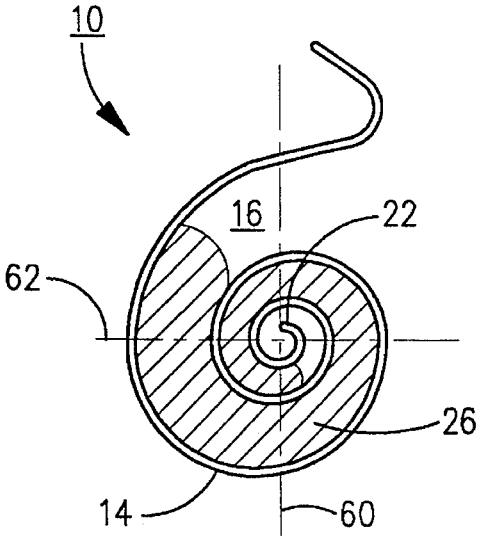

FIG. 6 illustrates a bundle 26 of thick hair received within hair-receiving volume 16 of device 10. The thick hair does not reach stop 22 at the inner radial end of hair-receiving volume 16. This is due to the greater thickness of the stands of hair 26 in FIG. 6 in hair-receiving volume 16, compared to hair 26 in FIG. 5. Thicker hair 26 in FIG. 6, accordingly, resists being inserted all the way into hair-receiving volume 16, and is secured in the position shown by the force of the adjacent, radially directed walls of spiral section 14 pressing against the hair.

FIGS. 5 and 6 merely show illustrative applications of the hair bundling device of the presently invention. Other factors, such as volume of hair, will affect how much of hair-receiving volume 16 is filled with hair. For thick hair with a normal adult volume, typically about 2½ through 3½ spiral revolutions of hair-receiving volume 16 will become filled. For thin hair with a normal adult volume, the number of revolutions is typically between about 1½ and 2½ revolutions. Beneficially, therefore, hair bundling device 10 of FIGS. 5 and 6 can accommodate a wide range of hair bundles of different volumes and thicknesses of hair strands.

Figure 7:
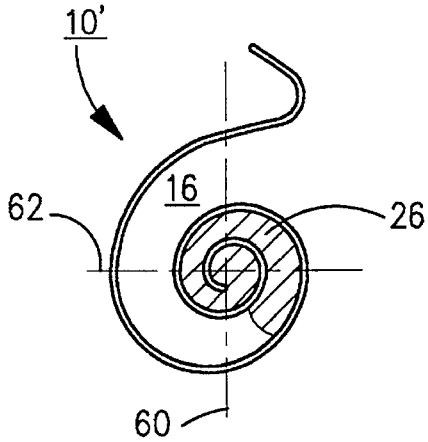
FIG. 7 shows a smaller hair bundling device than is shown in the prior figures, and is useful for children or other persons with less volume of hair relative to the cases illustrated in FIGS. 5 and 6.

For a child, or for adults with a relatively low volume of hair, a smaller hair bundling device 10', shown in FIG. 7, with fewer spiral revolutions of hair-receiving volume 16 than as shown in FIGS. 5 and 6, may be used.

When a device 10 of the invention is unflexed, hair-receiving volume 16 preferably decreases in radial dimension with respect to main axis 24 (FIG. 2) more than about 15 percent from a radially outer, to a radially inner, portion of one spiral turn of the hair-receiving volume other than innermost and outermost 45° (or, alternatively, 90°) spiral regions of the hair-receiving volume. This creates an increasing holding pressure on hair received within the hair-receiving volume as the hair is moved radially inwardly along the one spiral turn. For the same purpose, when an inventive device is unflexed, hair-receiving volume 16 more preferably decreases in radial dimension with respect to main axis 24 more than about 25 percent from a radially outer, to a radially inner, portion of one and one-half spiral turns of the hair-receiving volume other than innermost and outermost 45° (or, alternatively, 90° ) spiral regions of the hair-receiving volume. As mentioned above, such decrease in radial dimension occurs in a preferably continual, or even constant, manner. More broadly, however, over the mentioned turn or turns of the hair-receiving volume in a direction radially inwardly to main axis 24, there is preferably not any substantial increase in the mentioned radial dimension of the hair-receiving volume; a substantial increase followed by a rapid decrease would tend to impede the movement of hair radially inwardly along the hair-receiving volume.

Figure 8:
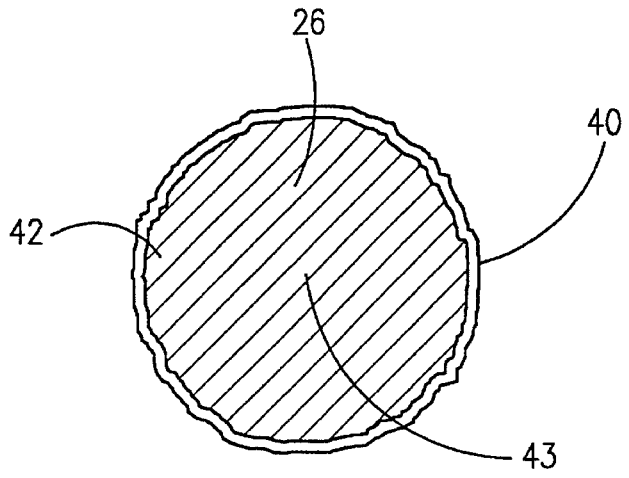
FIG. 8 PRIOR ART
FIG. 8 shows a prior art elastic band securing a bundle of hair.

FIG. 8 shows a prior art device 40 in the form of an elastic band, for securing a bundle of hair 26. Elastic band 40 exerts most of its pressure on strands of hair at the surface of bundle 26, e.g. at 42, immediately adjacent elastic band 40. This, not uncommonly, can cause a hair breakage line on such hair at the surface of the hair bundle. Meanwhile, the considerable separation of the inner-radial strands of hair bundle 26, e.g. at 43, from elastic band 40 results in such strands being under considerably less pressure. Such radially inner hair strands, therefore, are not as well secured as hair strands at the surface of hair bundle 26, and, not uncommonly, can result in the radially inner strands becoming out of place.

In contrast, the hair bundling device of the present invention exerts a more nearly uniform pressure over all strands of hair that are secured. This is apparent from the above description of the present inventive hair bundling device, especially in connection with FIGS. 4–7. Referring to FIG. 5, for example, the pressure exerted on hair 26 by the radially directed walls of spiral section 14 passes across a considerably shorter distance than is the case with the elastic band arrangement of FIG. 8.

Figure 9:
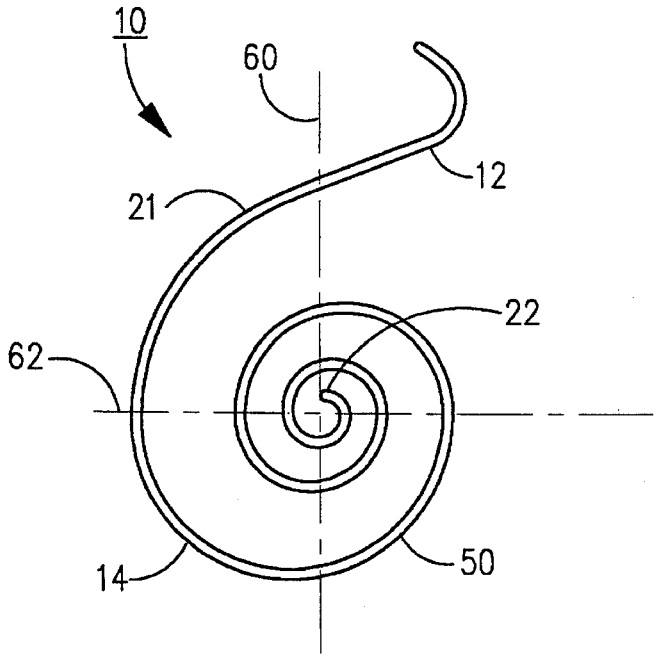
FIG. 9 is an upper plan view of a particular embodiment of an inventive hair bundling device, drawn to scale, for describing preferred dimensions.
Figure 9A:
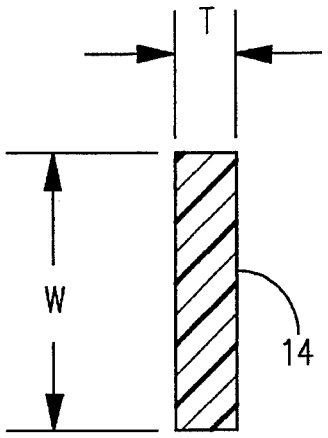
FIG. 9A shows a transverse cross-section of the spiral section of the device of FIG. 9, drawn relatively larger, but also respectively to scale.

FIG. 9 shows an upper view of an exemplary hair bundling device 10, drawn to scale, and FIG. 9A shows a relatively enlarged, transverse cross-section of spiral section 14 of the device. FIGS. 9 and 9A are respectively drawn to scale. The following dimensions are, therefore, merely exemplary, and persons skilled in the art will find many other dimensions and configurations apparent from the present specification.

Referring to FIG. 9, the length of spiral section 14, from stop 22 at the radial center of spiral section 14, to boundary point 21 where handle 12 starts, may be approximately 18 centimeters. Handle 12 may, for instance, have a length as shown, given the fact that the drawing is to scale. Stop 22 may have a length of, for instance, about 3 millimeters, measured radially. Meanwhile, referring to FIG. 9A, the thickness T of spiral section 14 at point 50, for instance, may be approximately 2 millimeters, and the width W of the section, about 9 millimeters. In a molded device comprising a strip of high-impact styrene plastic, for instance, the thickness T of spiral section 14 may vary from top to bottom as shown in FIG. 9A; such variation may be, for instance, from about 1.5 millimeters to about 2 millimeters. Such variation in thickness of section 14, is merely incident to a particular type of molding process, and there need be no variation at all.

The width W of spiral section 14 is preferably between about 4 millimeters and 2 centimeters, and more preferably at or below about 1 centimeter. Such axial compactness is desirable to minimize bulkiness of a device in a person's hair, while providing an adequate density of pressure per unit area for holding the hair in place.

Figure 10:
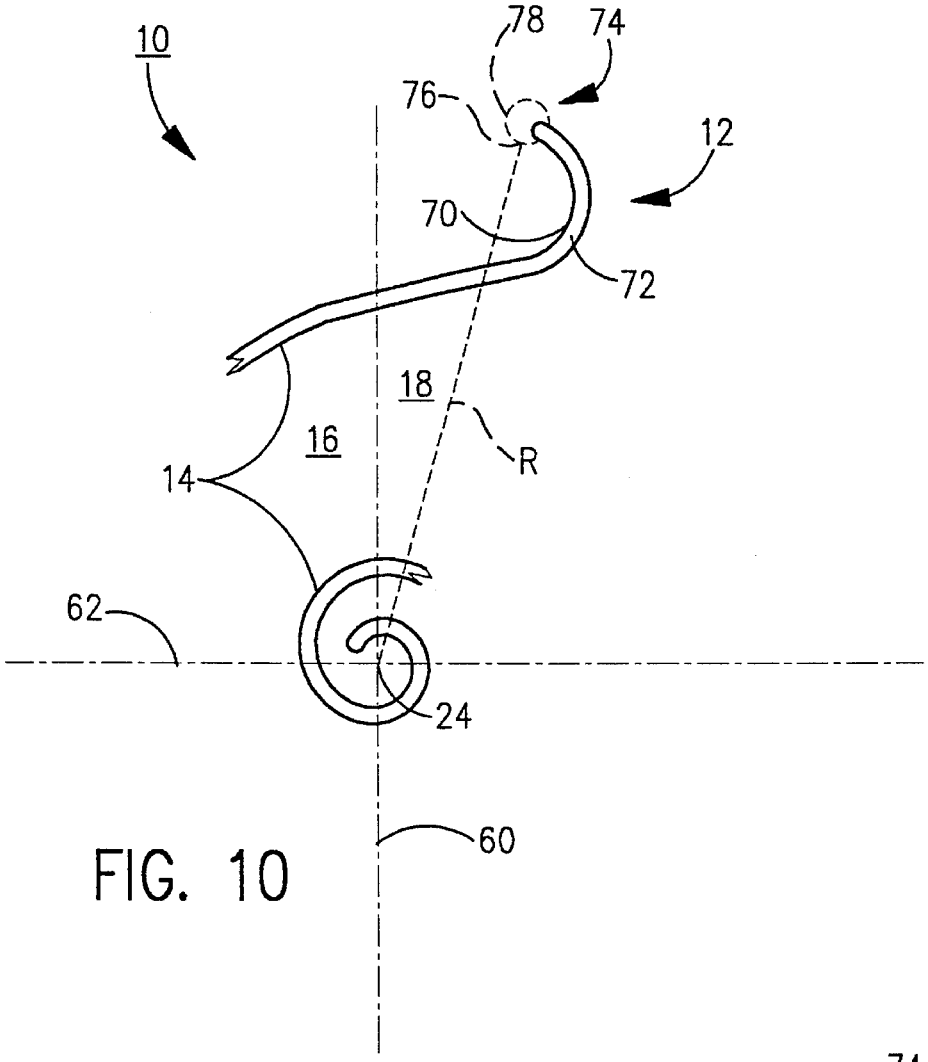
FIG. 10 shows fragmentary portions of inventive device to illustrate preferred features of handle for manipulating the device into a hair-securing position.

FIG. 10 illustrates preferred features of handle 12 that facilitate manipulation of the inventive device into a hair-securing position. As shown, handle 12 includes a surface 70 that is substantially parallel to a radius R originating at main axis 24. Surface 70 facilitates one-finger pulling of the handle tangentially to the main axis for rotating hair-receiving inlet 18 so as to receive hair. While one-finger pulling is facilitated, a user can, alternatively, manipulate the device with other than one finger. Surface 70 is still considered, in a structural sense, to facilitate the mentioned one-finger pulling; the same is true for other surfaces described herein as facilitating one-finger pulling. Handle 12 further includes a grippable portion 72 to facilitate pulling of the handle radially outwardly from axis 24 for increasing the hair-receiving volume of inlet region 18 and interiorly adjacent region 16. It is preferred that-grippable portion 72 be so located that gripping of such portion by a user's fingers will not block any substantial amount of hair from being received into regions 16 and 18. Thus, grippable portion 72 is shown protruding generally radially outwardly from adjacent spiral portion 14 with respect to main axis 24.

Figure 11:
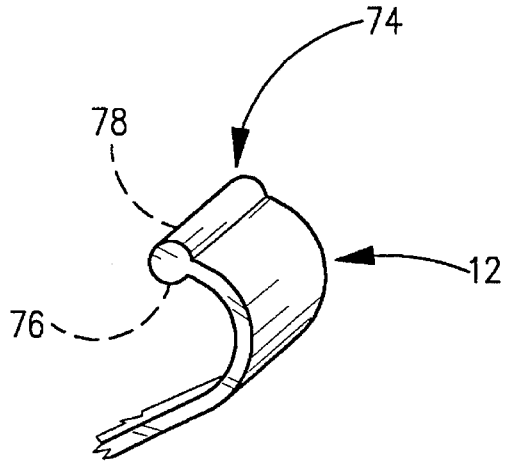
FIG. 11 is a detail view, in perspective, of the handle shown in FIG. 10.

As shown in phantom, handle 12 may include a generally enlarged region 74, which may have a generally cylindrical shape with a main axis parallel to main axis 24. Such a cylindrical shape for enlarged region 74 is shown more fully in the detail view of FIG. 11. Beneficially, enlarged region 74 has a surface 76 that faces substantially directly towards main axis 24. Surface 74 facilitates one-finger pulling of the handle radially outwardly from axis 24 for increasing the hair-receiving volume of the device. Enlarged region 74 also has a surface 78 that is substantially parallel to radius R (FIG. 10) originating at main axis 24. Surface 78 facilitates one-finger pulling of the handle tangentially to the main axis for rotating hair-receiving inlet 18 so as to receive hair. Beneficially, with surfaces 76 and 78 being adjacent to each other as shown, a user can very easily and naturally pull handle 12 in both directions 30 and 32 simultaneously as shown in FIG. 4 and as described above in connection with that figure. This simplifies insertion of the device into a hair-securing position.

The mentioned strip of high-impact styrene plastic material is presently preferred for at least spiral section 14 of the device. In addition to economy of manufacture, such plastic material, with the dimensions mentioned in connection with FIGS. 9 and 9A, has the requisite degree of springlike nature of spiral section 14 so as to be easily inserted into a securing position in a bundle of hair, while maintaining sufficient pressure against the hair to hold the hair in place. In a test measurement of such material, one end of a horizontally positioned strip of such material of approximately 11.5 centimeters length, whose other end was held stationery, was deflected approximately 1.8 centimeters vertically downwards by a weight of approximately 73 grams. It is believed, however, that material in a range between about 20% softer (or less stiff), and 40% stiffer, than indicated by the foregoing deflection test would adequately secure hair with the inventive hair bundling device.

A hair bundling device having the above-illustrated dimensions, as mentioned in connection with FIGS. 9 and 9A, and comprising high impact styrene plastic is very lightweight, for instance about 5 grams, including handle 12. Preferably such weight is no more than about 10 grams, although devices that are no more than about 15 grams are also so lightweight that typical forces of momentum, caused from a user jogging, for instance, fail to dislodge the device from the hair. Additionally, such lightweight devices need not rest on a user's head, but typically remain in place on a hair bundle that it secures.

From the foregoing, it will be appreciated that the present invention provides a hair bundling device that exerts, on a bundle of hair, a more nearly uniform pressure than has been attained with the prior art devices mentioned above. The hair bundling device can accommodate a wide range of hair bundles of different volumes and thicknesses of hair strands. It can be conveniently applied from a direction transverse to the bundle of hair, thereby avoiding the need to pass the free ends of such hair through the device, and can be manufactured economically. Lightweight versions, moreover, of the device are so lightweight that typical forces of momentum, caused from a user jogging, for instance, fail to dislodge the device from the hair.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A device for holding hair in a bundle, comprising:

(a) a body member configured in a generally spiral manner from proximate a main axis of the device to an opening for receiving hair; portions of said body member that are radially adjacent to each other with respect to said main axis presenting confronting surfaces for applying pressure to hair and defining a generally spirally shaped hair-receiving volume;

(b) a sufficient extent of said body member comprising resilient material for allowing an ordinary user to increase said hair-receiving volume, during insertion of the device onto a bundle of hair, more than about 50 percent in an outermost 180° spiral region bounded by said opening for receiving hair; and (c) when the device is unflexed, said hair-receiving volume decreases in radial dimension with respect to said main axis more than 15 percent from a radially outer, to a radially inner portion of one spiral turn of said hair-receiving volume other than innermost and outermost 45° spiral regions of said hair-receiving volume, so as to create an increasing holding pressure on hair received within said hair-receiving volume as said hair is moved radially inwardly along said one spiral turn.

2. The device of claim 1, when the device is unflexed, said hair-receiving volume decreases in radial dimension with respect to said main axis more than 15 percent from a radially outer to a radially inner portion of one spiral turn of said hair-receiving volume other than innermost and outermost 90° spiral regions of said hair-receiving volume,

3. The device of claim 1, wherein, when the device is unflexed, said hair-receiving volume decreases in radial dimension with respect to said main axis along said one spiral turn of said hair-receiving volume without any substantially increase in such dimension in a radially inward direction, so as to avoid impeding movement of hair radially inwardly along said hair-receiving volume.

4. The device of claim 1, wherein, when the device is unflexed, said hair-receiving volume decreases in radial dimension with respect to said main axis more than 25 percent from a radially outer to a radially inner portion of one and one-half spiral turns of said hair-receiving receiving volume other than innermost and outermost 45° spiral regions of said hair-receiving volume.

5. The device of claim 4, wherein, when the device is unflexed, said hair-receiving volume decreases in radial dimension with respect to said main axis along said one and one-half spiral turns of said hair-receiving volume without any substantially increase in such dimension in a radially inward direction, so as to avoid impeding movement of hair radially inwardly along said hair-receiving volume.

6. The device of claim 1, wherein, when the device is unflexed, said hair-receiving volume decreases in radial dimension with respect to said main axis from said opening to an inner extremity beyond which hair is blocked from moving further spirally inwards without any substantially increase in such dimension in a radially inward direction, so as to avoid impeding movement of hair radially inwardly along said hair-receiving volume.

7. The device of claim 1, wherein surfaces of said body member for applying pressure to hair are generally flat.

8. The device of claim 7, wherein said generally flat surfaces extend in a direction generally parallel to said main axis for more than 0.5 centimeters.

9. The device of claim 1, wherein the device weighs no more than 10 grams.

10. A device for holding hair in a bundle, comprising:

(a) a body member that is configured in a generally spiral manner from proximate a main axis of the device to an opening for receiving hair; portions of said body member that are radially adjacent to each other with respect to said main axis presenting confronting surfaces for applying pressure to hair and defining a generally spirally shaped hair-receiving volume; and (b) when the device is unflexed, said hair-receiving volume decreases in radial dimension with respect to said main axis more than about 15 percent from a radially outer, to a radially inner, portion of one spiral turn of said hair-receiving volume other than innermost and outermost 45° spiral regions of said hair-receiving volume, so as to create an increasing holding pressure on hair received within said hair-receiving volume as said hair is moved radially inwardly along said one spiral turn;

(c) said body member comprising, in the proximity of said opening for receiving hair, a handle comprising:

(i) a first surface that is substantially parallel to a radius originating at said main axis, for facilitating one-finger pulling of said handle tangentially to said main axis, relative to the bundle of hair, for rotating said opening for receiving hair so as to receive hair; and (ii) a grippable portion for facilitating pulling of said handle radially outwardly from said main axis for increasing said hair-receiving volume.

11. The device of claim 10, wherein, when the device is unflexed, said hair-receiving volume decreases in radial dimension with respect to said-main axis along said one spiral turn of said hair-receiving volume without any substantially increase in such dimension in a radially inward direction, so as to avoid impeding movement of hair radially inwardly along said hair-receiving volume.

12. The device of claim 10, wherein, when the device is unflexed, said hair-receiving volume decreases in radial dimension with respect to said main axis more than 15 percent from a radially outer to a radially inner portion of one spiral turn of said hair-receiving volume other than innermost and outermost 90° spiral regions of said hair-receiving volume.

13. The device of claim 12, wherein, when the device is unflexed, said hair-receiving volume decreases in radial dimension with respect to said main axis along said one spiral turn of said hair-receiving volume without any substantially increase in such dimension in a radially inward direction, so as to avoid impeding movement of hair radially inwardly along said hair-receiving volume.

14. The device of claim 10, wherein, when the device is unflexed, said hair-receiving volume decreases in radial dimension with respect to said main axis from said opening to an inner extremity beyond which hair is blocked from moving further spirally inwards without any substantial increase in such dimension in a radially inward direction, so as to avoid impeding movement of hair radially inwardly along said hair-receiving volume.

15. The device of claim 10, wherein said handle further includes a second surface facing substantially directly towards said main axis for facilitating one-finger pulling of said handle radially outwardly from said main axis, relative to the bundle of hair, for increasing said hair-receiving volume.

16. The device of claim 15, wherein said first and second surfaces of said handle are adjacent to each other.

17. The device of claim 10, wherein surfaces of said body member for applying pressure to hair are generally flat and extend in a direction generally parallel to said main axis for more than about 0.5 centimeters.

* * * * *